US005613415A

United States Patent [19]

Sanpei

[11] Patent Number: 5,613,415

[45] Date of Patent: Mar. 25, 1997

[54] PAPER CUTTING APPARATUS

[75] Inventor: Takaaki Sanpei, Tokyo, Japan

[73] Assignee: NEC Corporation, Tokyo, Japan

[21] Appl. No.: 440,454

[22] Filed: May 12, 1995

[30] Foreign Application Priority Data

May 16, 1994 [JP] Japan ..... 6-124719

[51] Int. Cl.[6] ..... B26D 7/32

[52] U.S. Cl. ..... 83/86; 83/165; 83/455; 83/485; 83/614; 271/84; 271/268

[58] Field of Search ..... 358/304; 83/614, 83/86, 165, 453, 456, 487, 485; 271/84, 268, 267

[56] References Cited

U.S. PATENT DOCUMENTS

| | | | |
|---|---|---|---|
| 2,914,324 | 11/1959 | Brainard | 271/84 |
| 3,457,814 | 7/1969 | Muchnik | 83/86 |
| 3,986,419 | 10/1976 | Cleghorn | 83/174 |
| 4,383,458 | 5/1983 | Kitai et al. | 83/405 |
| 4,413,542 | 11/1983 | Rempel | 83/614 |
| 4,515,053 | 5/1985 | DuBois | 83/578 |
| 4,633,745 | 1/1987 | Asano | 83/614 |
| 4,641,829 | 2/1987 | Kolblin | 271/268 |
| 4,701,063 | 10/1987 | Wysk et al. | 400/621 |
| 4,721,058 | 1/1988 | Hayamizu et al. | 358/304 |
| 4,879,948 | 11/1989 | Bubley | 271/268 |
| 5,168,786 | 12/1992 | Huggins et al. | 83/614 |
| 5,303,626 | 4/1994 | Uehara et al. | 83/485 |

FOREIGN PATENT DOCUMENTS

| | | | |
|---|---|---|---|
| 008434 | 7/1983 | European Pat. Off. . | |
| 181151 | 6/1922 | United Kingdom | 271/84 |
| 441550 | 1/1936 | United Kingdom . | |
| 2070496 | 9/1981 | United Kingdom . | |
| 2223201 | 4/1990 | United Kingdom | 83/86 |

*Primary Examiner*—Rinaldi I. Rada
*Assistant Examiner*—Charles Goodman
*Attorney, Agent, or Firm*—Sughrue, Mion, Zinn, Macpeak & Seas

[57] ABSTRACT

A paper cutting apparatus includes an elongated fixed blade, a movable blade, a fixed member, a pair of paper holding members, and a coupling portion. The movable blade reciprocates along the fixed blade in the direction of the width of paper to cut the paper in cooperation with the fixed blade. The fixed member is arranged midway along the path of the movable blade. The paper holding members are movably arranged on two sides of the fixed member and alternately hold the cut end portion of the paper cut by the movable blade. The coupling portion detachably couples the movable blade and the paper holding members with a predetermined coupling force, and cancels the coupling between the movable blade and one of the paper holding members by using the fixed member, while coupling the movable blade and the other of the paper holding members during movement of the movable blade in a paper cutting operation.

9 Claims, 4 Drawing Sheets

PAPER CUTTING APPARATUS

BACKGROUND OF THE INVENTION

The present invention relates to a paper cutting apparatus which is mounted in a facsimile apparatus, a printer, or the like to cut a roll of recording paper to a necessary length with a cutter after information is recorded on the paper.

FIG. 7 shows a facsimile apparatus in which a conventional paper cutting apparatus is mounted. Referring to FIG. 7, reference numeral 102 denotes a roller of recording paper; 103, a thermal head for generating heat in accordance with a signal from a control section (not shown) to cause a black printing reaction on the recording paper 102; 104, a platen roller which is arranged on the printing line of the thermal head 103 to press the recording paper 102 against the thermal head 103 so as to convey the recording paper 102 upon pivotal movement; 140, a cutting apparatus for cutting the recording paper 102 to a predetermined length in accordance with a signal from the control section; and 141, a plate-like stacker extending obliquely upward from a position below the cutting position of the cutting apparatus 140 and having almost the same surface area as that of cut recording paper 107. The recording paper 107 cut by the cutting apparatus 140 drops onto the stacker 141 by gravity.

The above conventional paper cutting apparatus requires the stacker 141 for storing the cut recording paper 107. For this reason, the stacker 141 having a size corresponding to a predetermined cutting length, e.g., JIS A4 or B4 size, protrudes outward from a facsimile apparatus aiming at a reduction in size, as shown in FIG. 7. Therefore, the user of a facsimile apparatus having such a structure must ensure a wide installation place for the stacker 141. In addition, in order to prevent operators around the facsimile apparatus from bumping against the stacker 141, the installation place is undesirably limited.

SUMMARY OF THE INVENTION

It is an object of the present invention to provide a paper cutting apparatus which allows a reduction in size of an apparatus in which the cutting apparatus is mounted.

It is another object of the present invention to provide a paper cutting apparatus which impose no limitation on the installation place of the apparatus.

In order to achieve the above objects, according to the present invention, there is provided a paper cutting apparatus comprising an elongated fixed blade, a movable blade which reciprocates along the fixed blade in the direction of width of paper to cut the paper in cooperation with the fixed blade, a fixed member arranged midway along a path of the movable blade, a pair of paper holding members, movably arranged on two sides of the fixed member, for alternately holding a cut end portion of the paper cut by the movable blade, and coupling means for detachably coupling the movable blade and the paper holding members with a predetermined coupling force, and canceling coupling between the movable blade and one of the paper holding members by using the fixed member, while coupling the movable blade and the other of the paper holding members during movement of the movable blade in a paper cutting operation.

DESCRIPTION OF THE PREFERRED EMBODIMENT

Figure 1:
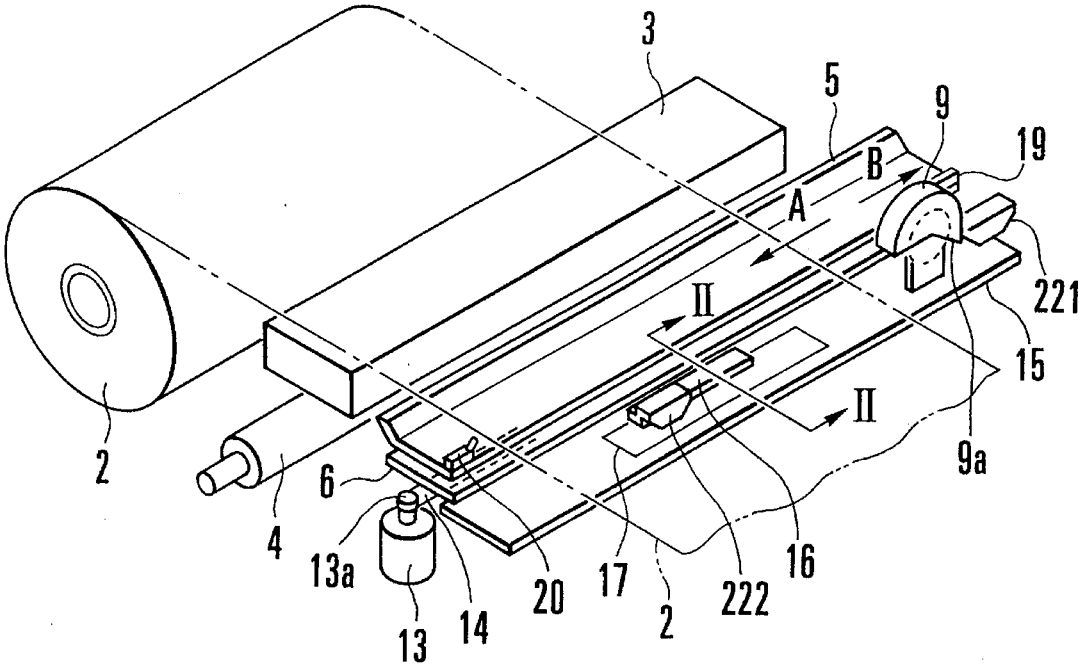
FIG. 1 is a perspective view showing a paper cutting apparatus, which is mounted in a facsimile apparatus, according to an embodiment of the present invention.
Figure 2:
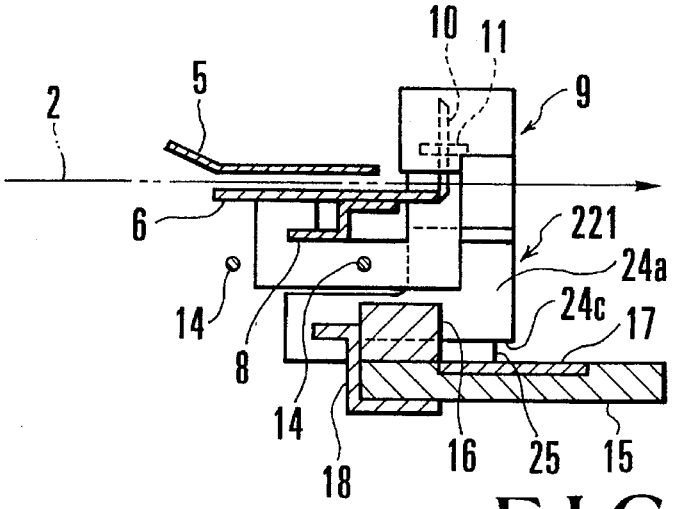
FIG. 2 is a sectional view taken along a line II—II of the paper cutting apparatus.

A paper cutting apparatus according to an embodiment of the present invention will be described below with reference to the accompanying drawings by taking the case of the paper cutting apparatus mounted in a facsimile apparatus. Referring to FIGS. 1 and 2, reference numeral 2 denotes a roller of recording paper; 3, a thermal head for generating heat in accordance with a signal from a control section (not shown) to cause a black printing reaction on the recording paper 2; 4, a platen roller which is arranged on the printing line of the thermal head 3 to press the recording paper 2 against the thermal head 3 so as to convey the recording paper 2 upon pivotal movement; 5, an elongated paper guide fixed to the housing (not shown) of the facsimile apparatus; and 6, a plate-like fixed blade opposing the paper guide 5 via a small gap and having a width larger than that of the recording paper 2. The recording paper 2 is conveyed between the fixed blade 6 and the paper guide 5.

Reference numeral 8 denotes a guide plate which is fixed to the housing and on which the fixed blade 6 is mounted; 9, a movable blade holding member which has a guide surface 9a inclined downward to guide the recording paper 2 cut by the fixed blade 6 and is guided by the guide plate 8 to be movable in the A–B direction in FIG. 1; 10, a thin, circular, movable blade which is supported by a shaft 11 extending horizontally in the movable blade holding member 9 to be pivotal with some resistance and is positioned by the guide plate 8 to come into contact with an end face of the fixed blade 6; 12, an iron plate mounted to the movable blade holding member 9; 13, a driving motor for the movable blade holding member 9; 14, a wire which is stretched between a reel 13*a* of the driving motor 13 and a pulley (not shown) and to which a portion of the movable blade holding member 9 is fixed. The movable blade 10 is moved along the fixed blade 6 in the A–B direction via the movable blade holding member 9 by clockwise/counterclockwise rotation of the driving motor 13.

Reference numeral 15 denotes a flat member fixed to the housing at a position below the fixed blade 6 to be parallel thereto. A fixed block 16 is fixed to the central portion of the flat member 15. A rubber member 17 having a large frictional force is mounted on a surface of the fixed block 16 in the lateral direction, i.e., the direction of width of the recording paper 2. Reference numeral 18 denotes a slide guide which is mounted to the flat member 15 to movably guide a pair of left and right holding blocks 221 and 222 in the A–B direction. The holding blocks 221 and 222 respectively move between one end of the fixed block 16 and one end of the slide guide 18 and between the other end of the fixed block 16 and the other end of the slide guide 18. Reference numerals 19 and 20 denote switches respectively mounted on the two ends of the paper guide 5 to restrict movement of the movable blade holding member 9 beyond certain limits.

Figure 3:
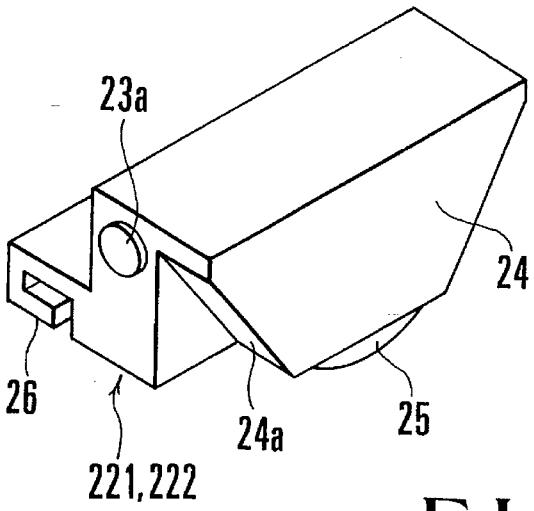
FIG. 3 is a perspective view showing a holding block of the paper cutting apparatus in FIG. 1.
Figure 4A:
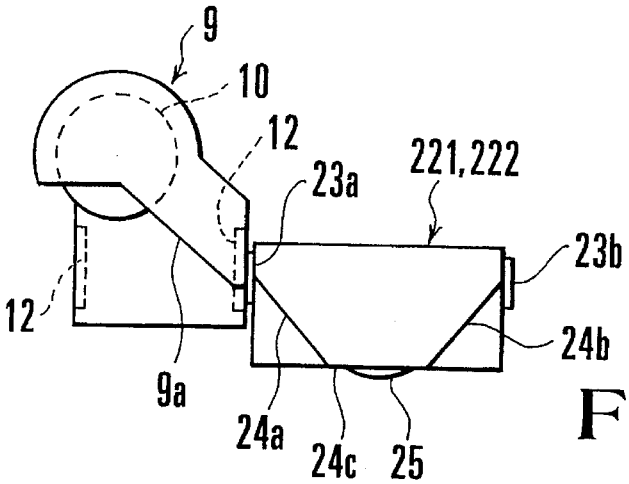
FIGS. 4A to 4C are side views showing various examples of the movable blade holding member and holding block of the paper cutting apparatus in FIG. 1.

As shown in FIGS. 3 and 4A, magnets 23*a* and 23*b* are respectively mounted on the left and right end faces of each of the holding blocks 221 and 222. An inverted trapezoidal projection 24 having inclined surfaces 24*a* and 24*b* on its two side surfaces extends from the front surface side of each of the holding blocks 221 and 222, i.e., the conveying direction of the recording paper 2. The inclined surfaces 24*a* and 24*b* communicate with the guide surface 9*a* of the movable blade holding member 9. An arcuated leaf spring 25 is mounted on a bottom surface portion 24*c* of the projection 24. A guide portion 26 having an L-shaped cross-section is formed on the rear surface side of the lower portion of each of the holding blocks 221 and 222. When the guide portion 26 is fitted on the slide guide 18, the leaf spring 25 opposes the rubber member 17 of the flat member 15. At this time, a gap is formed between the bottom surface portion 24*c* of the projection 24 and the flat member 15, and the projection 24 is movable in the A–B direction while the magnets 23*a* and 23*b* are held at a height to oppose the iron plate 12 of the movable blade holding member 9. FIG. 4A shows a state wherein the iron plate 12 is attracted to the magnet 23*a* owing to its attracting force, and the movable blade holding member 9 is magnetically coupled to the holding blocks 221 and 222.

Figure 4B:
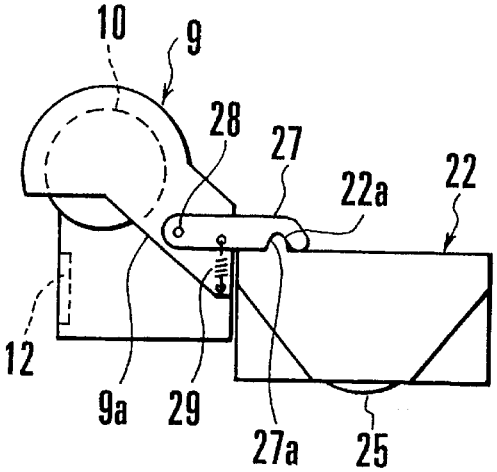

FIG. 4B shows the second example of the coupling structure of the movable blade holding member 9 and a holding block 22. In the second example, the movable blade holding member 9 has a hook 27 supported to be pivotal about a pin 28, and a spring 29 for providing the hook 27 with a clockwise pivoting behavior. The pivotal movement of the hook 27 is restricted by a stopper (not shown). A projection 22*a* extends from the upper end face of the holding block 22.

In this arrangement, when the movable blade holding member 9 is pressed against the holding block 22 surface 27*a* of the hook 27 is engaged with the projection 22*a*, so that the movable blade holding member 9 and the holding block 22 are mechanically coupled to each other. When a force acts on the movable blade holding member 9 and the holding block 22 to separate them from each other, the hook 27 and the projection 22a are disengaged from each other against the biasing force of the spring 29.

Figure 4C:
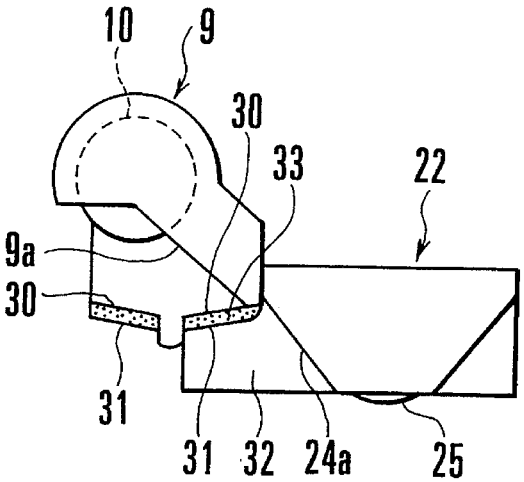

FIG. 4C shows the third example of the coupling structure of the movable blade holding member 9 and a holding block 22. In the third example, the bottom surface of the movable blade holding member 9 is formed as an inclined surface 30, and sponge rubber 31 having a large frictional force is mounted on the inclined surface 30. A front end 32 extends from the holding block 22. An inclined surface 33 having the same gradient as that of the inclined surface 30 is formed on the front end 32.

In this arrangement, when the movable blade holding member 9 is pressed against the holding block 22, the inclined surfaces 30 and 33 are pressed against each other. As a result, the sponge rubber 31 is compressed, and the movable blade holding member 9 and the holding block 22 are coupled to each other with a frictional force produced between the sponge rubber 31 and the inclined surface 33. When an external force larger than the frictional force acts on the movable blade holding member 9 and the holding block 22 to separate the from each other, the coupling is canceled against the frictional force.

Figure 5A:
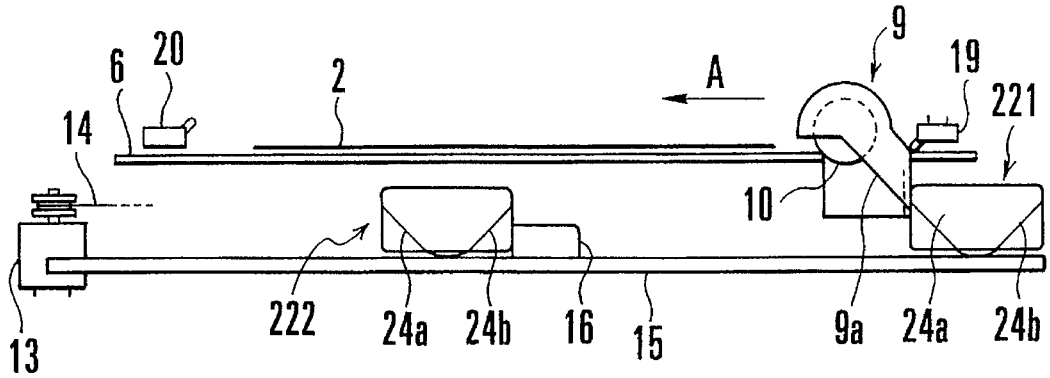
FIGS. 5A to 5D are side views showing the process of holding cut recording paper in the paper cutting apparatus in FIG. 1.

The cutting operation of the paper cutting apparatus having the coupling structure shown in FIG. 4A will be described next with reference to FIGS. 5A to 5E. Assume that the movable blade holding member 9 is located and stopped outside the width of the recording paper 2 by the switch 19, as shown in FIG. 5A, and the holding block 221 is coupled to the movable blade holding member 9 with the attracting force between the magnet 23*a* and the iron plate 12, as shown in FIG. 4A. As shown in FIG. 1, when an image is printed on the recording paper 2 by the thermal head 3, and the recording paper 2, on which the image is recorded, is conveyed in the conveying direction by a predetermined amount, the motor 13 is rotated to move the movable blade holding member 9 in the direction indicated by an arrow A. Upon movement of the movable blade holding member 9, the movable blade 10 is slid along the end face of the fixed blade 6 to cut the recording paper 2.

Figure 5B:
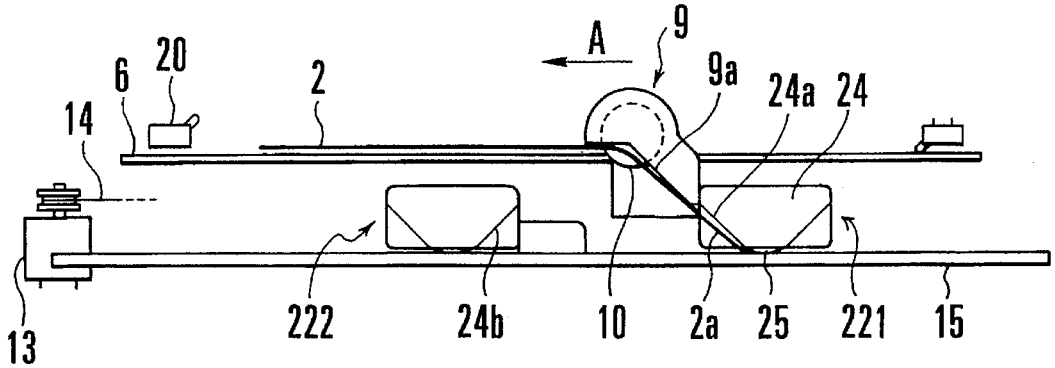

A cut end portion 2*a* of the cut recording paper 2 is guided to the guide surface 9*a* of the movable blade holding member 9, as shown in FIG. 5B, and is further guided to the gap between the flat member 15 and the bottom surface portion 24*c* of the projection 24 of the holding block 221 via the inclined surface 24*a* of the holding block 221. In addition, upon movement of the holding block 221 in the direction indicated by the arrow A, the cut end portion 2*a* of the recording paper 2 is clamped between the leaf spring 25 and the rubber member 17 of the flat member 15. In this case, since the leaf spring 25 and the rubber member 17 are respectively arranged on the holding block 221 and the flat member 15, the holding force for folding the cut end portion 2*a* increases to reliably hold the recording paper 2.

Figure 5C:
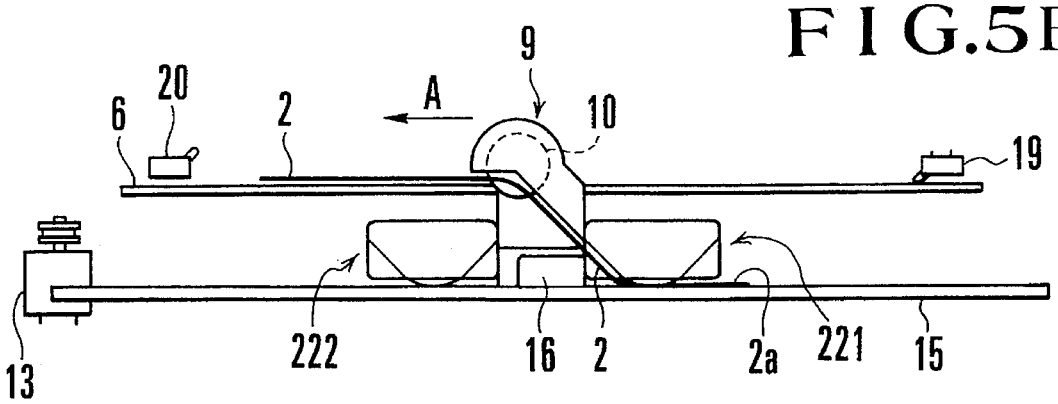

When the movable blade holding member 9 further moves in the direction indicated by the arrow A, the holding block 221 is brought into contact with the fixed block 16 to be disengaged from the movable blade holding member 9, and the holding block 221 holds the cut end portion 2*a* of the recording paper 2 while the holding block 221 is in contact with the fixed block 16 and remains stationary, as shown in FIG. 5C. At almost the same time, the magnet 23*b* of the holding block 222 is attracted to the iron plate 12 of the movable blade holding member 9. As a, result, the holding block 222 is coupled to the movable blade holding member 9. The movable blade holding member 9 moves in the direction indicated by the arrow A while pushing the holding block 222, and is detected by the switch 20 to stop at a position outside the width of the recording paper 2.

Figure 5D:
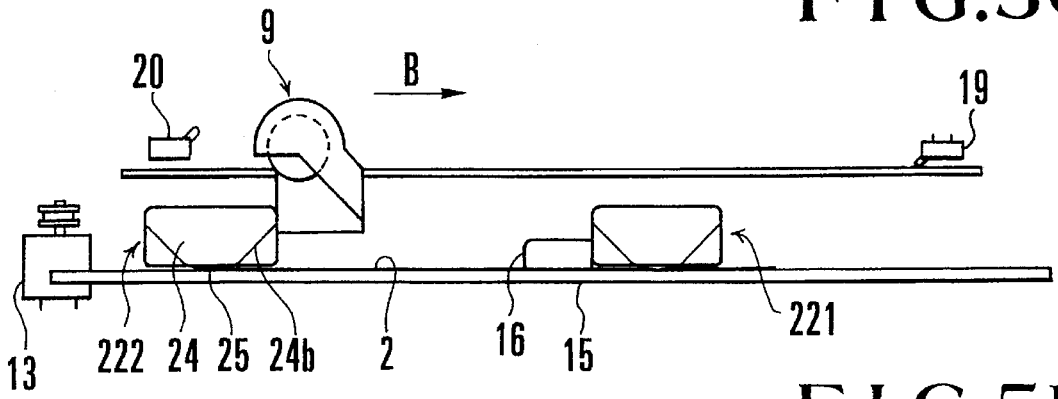
Figure 6:
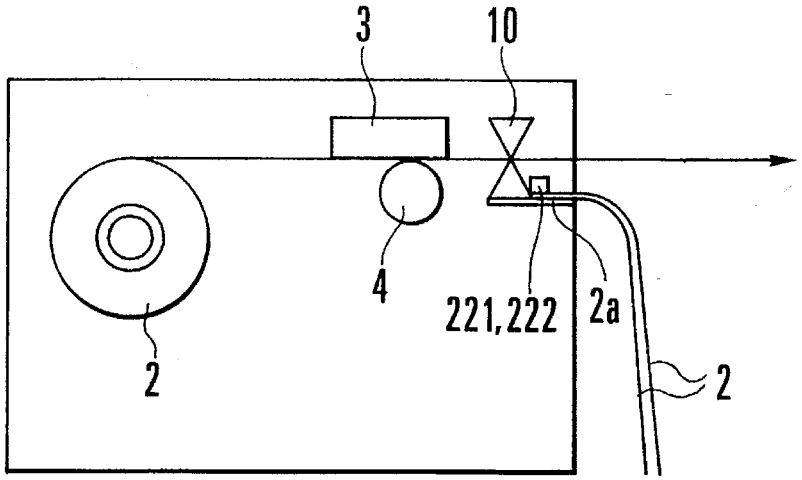
FIG. 6 is a side view showing a facsimile apparatus in which the paper cutting apparatus is mounted.
Figure 7:
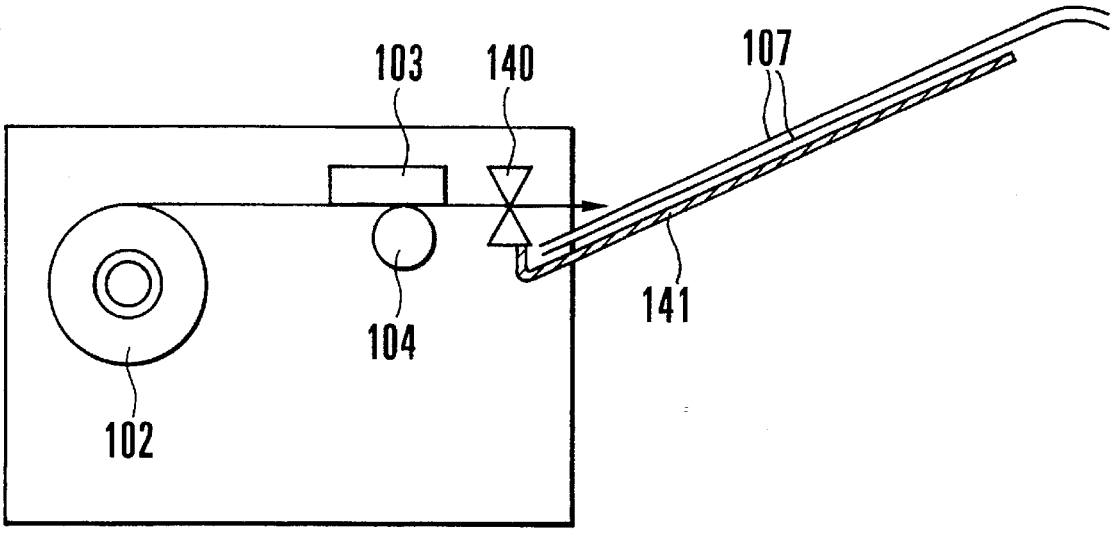
FIG.7 PRIOR ART
FIG. 7 is a side view showing a facsimile apparatus in which a conventional paper cutting apparatus is mounted.

When the rotation of the driving motor 13 is reversed afterward, the movable blade holding member 9 is magnetically coupled to the holding block 222 and moves in the direction indicated by an arrow B. In this case, as shown in FIG. 5D, the cut recording paper 2 in contact with the upper surface of the flat member 15 enters the gap between the flat member 15 and the bottom surface portion 24*c* of the projection 24 of the holding block 222 which moves in the direction indicated by the arrow B to be clamped between the leaf spring 25 and the flat member 15. When the holding block 222 comes into contact with the fixed block 16 in this state, the holding block 222 stops moving. As a result, the coupling between the fixed block 16 and the holding block 222 is canceled. At almost the same time, the holding block 221 is magnetically attracted and coupled to the movable blade holding member 9, and the movable blade holding member 9 moves in the direction indicated by the arrow B while pushing the holding block 221. The holding block 221 is then detected by the switch 19 to stop at a position outside the width of the recording paper 2 and waits for the recording paper 2 to be cut next. As described above, when the movable blade holding member 9 repeatedly reciprocates in the A–B direction, the cut end portion 2*a* of the recording paper 2 is stacked and held on the flat member 15 by means of the holding blocks 221 and 222, as shown in FIG. 6.

As described above, since the inclined surfaces 24*a* and 24*b* are formed on each of the blocks 221 and 222, which are identical members, the cut end portion 2*a* of the cut recording paper 2 is smoothly guided into the gap between the flat member 15 and the projection 24 of each of the holding blocks 221 and 222. In this case, the inclined surfaces 24*a* and 24*b* are formed on the two side surface portions of each of the holding blocks 221 and 222. If, however, it is only required to have a function of smoothly guiding the cut end portion 2*a* of the recording paper 2 cut by the movable blade 10 into the gap between the bottom surface portion 24*c* of each projection 24 and the flat member 15, only the inclined surface 24*a* may be formed. In addition, if the holding blocks 221 and 222 are not to be formed as identical members, the inclined surface 24*a* may be formed on only the holding block 221 but need not be formed on the holding block 222.

The above cutting operation has been described in conjunction with the first example shown in FIG. 4A. However, the same operation is performed even by using the movable blade holding member 9 and the holding blocks 22 according to the second and third examples shown in FIGS. 4B and 4C.

As has been described above, since cut paper is held by one of the pair of holding members designed to reciprocate upon movement of the movable blade, which comes into contact with the fixed member to stop, a stacker for stacking paper as in the prior art is not required. Therefore, the installation space for the apparatus can be reduced.

In addition, according to the present invention, in holding paper by using each holding member, the paper is held in the gap between the bottom surface portion of the holding member and the flat member arranged along the moving direction of the holding member. In addition, the inclined surfaces are formed on the side surface portions of the holding member to guide the cut end portion of the paper into the gap. Therefore, the paper can be smoothly held by the holding member.

Furthermore, according to the present invention, since the elastic member is mounted on the bottom surface portion of each holding member, the holding force for holding recording paper increases. Therefore, the recording paper can be reliably held.

Moreover, according to the present invention, since the rubber member is mounted on at least a portion of the surface of the flat member which opposes each holding member, the holding force for holding recording paper increases. Therefore, the recording paper can be reliably held.

What is claimed is:

1. A paper cutting apparatus comprising:

an elongated fixed blade;

a movable blade which reciprocates along said fixed blade in a direction of width of paper to cut the paper in cooperation with said fixed blade;

a fixed member arranged midway along a path of said movable blade;

a pair of paper holding members, movably arranged on two sides of said fixed member, for alternately holding a cut end portion of the paper cut by said movable blade; and coupling means for detachably coupling said movable blade and said paper holding members with a predetermined coupling force, said coupling means allowing decoupling between said movable blade and one of said paper holding members and coupling between said movable blade and the other of said paper holding members when said fixed member contacts said one of said paper holding members during movement of the movable blade along the fixed blade.

2. An apparatus according to claim 1, further comprising a movable blade holding member holding said movable blade and having a guide surface, inclined downward, for guiding the cut paper to a coupled paper holding member.

3. An apparatus according to claim 2, further comprising a flat base arranged along a moving direction of said paper holding members, and wherein at least one of said holding members includes a bottom surface portion for holding the cut paper between the bottom surface portion and said flat base, and an inclined surface for guiding the paper, guided by the guide surface of said movable blade holding member, to the bottom surface portion of said paper holding member.

4. An apparatus according to claim 3, further comprising an elastic member mounted on the bottom surface portion of each of said paper holding members, so that the cut paper is stacked and held between said elastic member and said flat base.

5. An apparatus according to claim 3, further comprising an elastic member mounted on at least a portion of an area of said flat base in which said paper holding members move, said elastic member having a large frictional force, so that the cut paper is stacked and held between said paper holding members and said elastic member.

6. An apparatus according to claim 2, wherein said coupling means comprises a magnet mounted on one of said movable blade holding member and said paper holding member, and a magnetic member which is mounted on the other of said movable blade holding member and said paper holding member to be magnetically coupled to said magnet.

7. An apparatus according to claim 2, wherein said coupling means comprises a hook formed on one of said movable blade holding member and said paper holding member, and a projection which is formed on the other of said movable blade holding member and said paper holding member to be mechanically engaged with said hook.

8. An apparatus according to claim 2, wherein said coupling means comprises an elastic member having a large frictional force and mounted on an inclined surface formed on one of said movable blade holding member and said paper holding member, said elastic member being engaged with an inclined surface formed on the other of said movable blade holding member and said paper holding member to couple said movable blade holding member and said paper holding member to each other with the frictional force.

9. A paper cutting apparatus comprising:

an elongated fixed blade;

a movable blade which reciprocates along said fixed blade in a direction of width of paper to cut the paper in cooperation with said fixed blade;

a fixed member arranged midway along a path of said movable blade;

a flat base arranged along a moving direction of said paper holding members;

a first paper holding member which is arranged to be movable to one side of said fixed member in accordance with a first half of a paper cutting operation, guides a cut end portion of the paper cut by said movable blade, and holds the paper between said first paper holding member and said flat base;

a second paper holding member which is arranged to be movable to the other side of said fixed member in accordance with a second half of the paper cutting operation, and holds the cut end portion of the paper cut by said movable blade; and coupling means for detachably coupling said movable blade and said first and second paper holding members with a predetermined coupling force, said coupling means allowing decoupling between said movable blade and first paper holding member and coupling between said movable blade and said second paper holding member when said fixed member contacts said first paper holding member during movement of the movable blade along the fixed blade.

* * * * *